United States Patent [19]

Cox

[11] Patent Number: 4,598,272

[45] Date of Patent: Jul. 1, 1986

[54] ELECTRONIC MONITORING APPARATUS

[76] Inventor: Randall P. Cox, 3570 St. Mathews Ct. SE., Port Orchard, Wash. 98366

[21] Appl. No.: 638,197

[22] Filed: Aug. 6, 1984

[51] Int. Cl.[4] ..... G08B 1/08

[52] U.S. Cl. ..... 340/539; 340/571; 340/573; 340/531; 340/825.49

[58] Field of Search ..... 340/539, 571, 572, 573, 340/825.36, 825.49, 825.72, 825.69, 696, 531; 367/197-199, 93, 94; 455/9, 54, 67, 95, 100

[56] References Cited

U.S. PATENT DOCUMENTS 4,496,469 10/1984 Lander ..... 340/539
4,507,653 3/1985 Bayer ..... 340/539

FOREIGN PATENT DOCUMENTS 2913563 10/1980 Fed. Rep. of Germany .
2301054 10/1976 France .
2482338 11/1981 France .

*Primary Examiner*—Donnie L. Crosland
*Attorney, Agent, or Firm*—Christopher Duffy

[57] ABSTRACT

The apparatus not only enables the monitoring person to monitor the whereabouts of the monitored person, pet or article, but also to locate the latter if he, she or it becomes separated from the monitoring person. It also enables the monitoring person to interrupt an abductor, to draw attention to him, to frighten or confuse him, and hopefully, to cause him to release the monitored person, pet or article.

8 Claims, 1 Drawing Figure

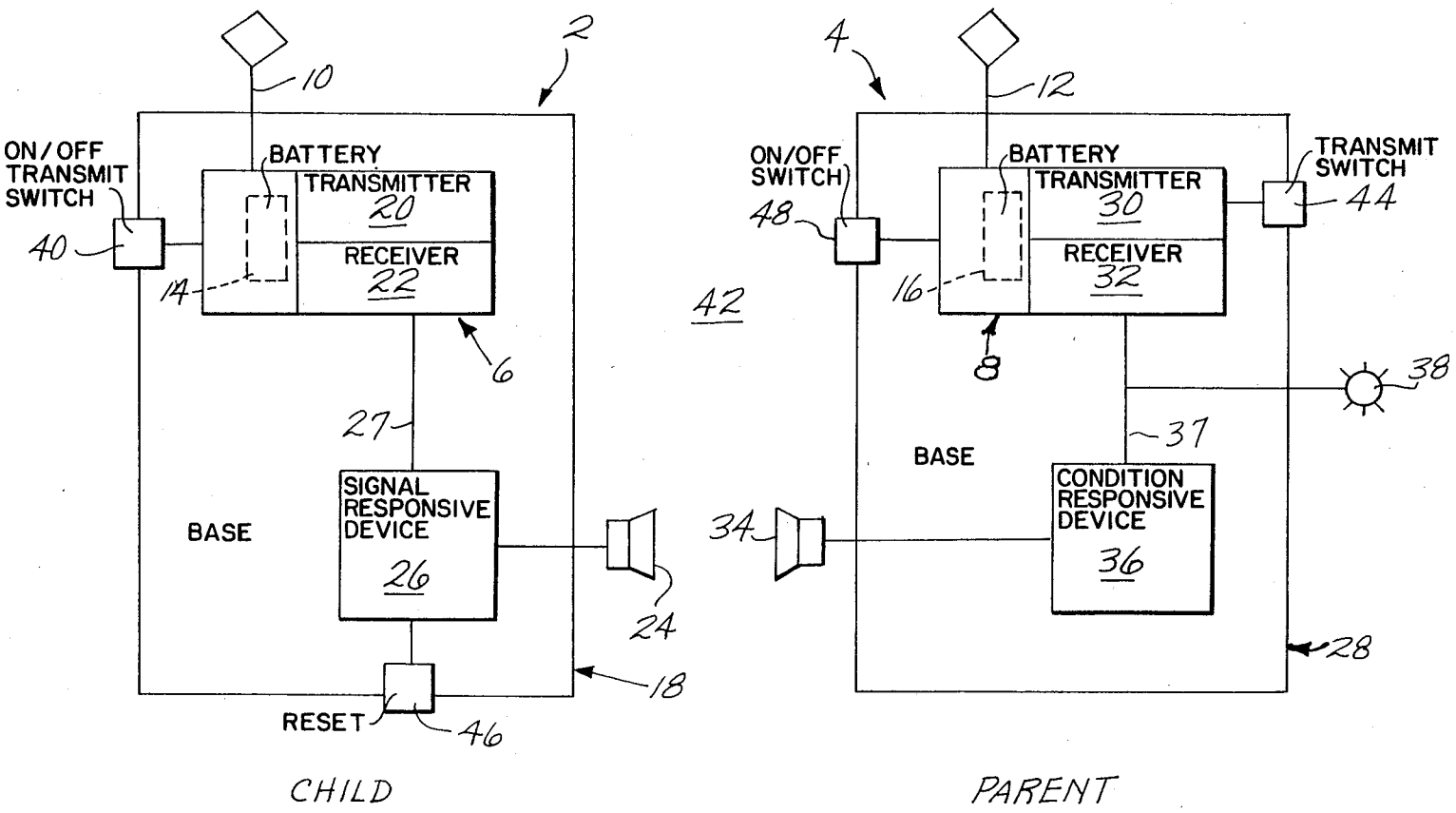
TRANSMIT SWITCH
44
38
28
BATTERY
TRANSMITTER
30
RECEIVER
32
37
CONDITION RESPONSIVE DEVICE
36
12
8
16
BASE
4
ON/OFF SWITCH
48
42
34
PARENT
24
18
2
6
BATTERY
TRANSMITTER
20
RECEIVER
22
27
SIGNAL RESPONSIVE DEVICE
26
46
RESET
10
14
BASE
ON/OFF TRANSMIT SWITCH
40
CHILD

ELECTRONIC MONITORING APPARATUS

BACKGROUND OF THE INVENTION

Child abduction is a major problem at this time and the number being abducted is growing each year. In fact, as many as 150,000 children are reported missing in the United States alone each year. Many of the abductions occur under circumstances wherein the child is in the company of a parent, such as at a shopping mall, but the parent is preoccupied otherwise, such as in shopping, and the child is abducted in a moment of inattention to it.

The present invention relates to an electronic monitoring apparatus for coping with this problem. One object of the invention is to provide an apparatus of this nature by which a parent can locate his or her child if the child becomes separated from the parent, or is perhaps shielded from the parent by an obstruction. Another object is to provide an apparatus of this nature whereby the parent can monitor the child's presence at all times, even at times of distraction or inattention, and then locate the child when it becomes separated or shielded from the parent. Still another object is to provide an apparatus of this nature whereby the parent can interrupt an abductor in the act of abduction, and moreover, draw attention to him on the part of those who may be in his presence at the time of the act. A still further object is to provide an apparatus of this nature which enables the parent to frighten or confuse the abductor, even while he is in the midst of his act, and hopefully to cause him to release the child. Other objects include the provision of an apparatus of this nature which is equally suitable for monitoring other personnel, such as patients in a nursing home or a hospital, or prisoners in the company of police or prison officials; and also for monitoring articles or pets in the supervision of someone equipped with the apparatus. Still other objects will become apparent from the description of the invention which follows hereafter.

THE INVENTION IN GENERAL

Broadly speaking, these and other related objects are realized by an apparatus of my invention which comprises a pair of base forming means which are separate and independent from one another and have first and second radio antenna means thereon, respectively. The first base forming means are portable and securable to the person, pet or article to be monitored so that they are transportable with him, her or it to points spaced apart from the second base forming means. The second base forming means have radio transmitter means thereon which are operable through the second antenna means to broadcast a signal into the space between the respective base forming means, and the transmitter means have selectively operable control means connected therewith whereby the monitoring person can actuate the transmitter means to broadcast the signal into the space between the base forming means when desired. Meanwhile, the first base forming means have means thereon for producing an audible alarm, battery operated radio receiver means thereon for receiving the signal through the first antenna means thereon, and signal responsive means thereon which are responsive to receipt of the signal to actuate the alarm. The alarm is adapted so that it is audible within a range of distance from the first base forming means commensurate with that over which the monitored person, pet or article is to be monitored, so that the monitoring person can locate the monitored person, pet or article by actuating the transmitter means to sound the alarm on such monitored person, pet or article.

Many of the presently preferred embodiments of the invention employ pairs of transmitter and receiver means and a pair of signals to enable the monitoring person to monitor the monitored person, pet or article even at times of distraction or inattention to his, her or its presence. For example, in one group of embodiments, the first base forming means are equipped with first radio antenna means and battery operated first radio transmitter means which are operable through the first antenna means to broadcast a first radio signal into the aforesaid space between the respective base forming means. The second base forming means, in turn, have first radio receiver means thereon and second radio antenna means connected therewith through which they receive the first signal at least up to a predetermined threshold condition therein. In addition, there are means for producing a first audible or visible alarm in the region of the second base forming means, and condition responsive means responsive to the incidence of the threshold condition in the first receiver means to actuate the first alarm producing means. There are also second radio transmitter means which are operable through the second antenna means to broadcast a second signal into the space between the respective base forming means. The second transmitter means have selectively operable control means connected therewith whereby the monitoring person can actuate the second transmitter means to broadcast the second signal into the space between the base forming means when desired. Meanwhile, the first base forming means also have means thereon for producing a second audible alarm, battery operated second radio receiver means thereon for receiving the second signal through the first antenna means, and signal responsive means thereon which are responsive to receipt of the second signal to actuate the second alarm. The second alarm is adapted in turn so that it is audible within a range of distance from the first base forming means commensurate with the threshold condition in the first receiver means, so that the monitoring person upon hearing or seeing the first alarm, can actuate the second transmitter means to locate the monitored person, pet or article by the sound of the second alarm thereon.

Ordinarily, the second base forming means are also portable and securable to the monitoring person; the first alarm producing means, the condition responsive means, the second transmitter means, the second antenna means and the control means are all disposed on the second base forming means; and the first receiver means and the second transmitter means are battery operated through the second antenna means.

In many embodiments of this particular group, the first transmitter means are adapted to broadcast a signal whose strength diminishes in relation to the distance of the same from the first base forming means. The first receiver means are adapted to receive the signal at least until it falls off to a predetermined low strength condition, and the condition responsive means are responsive to that low strength condition to actuate the first alarm producing means. The second transmitter means are adapted to broadcast a signal that is stronger and more far reaching than the distance corresponding to this threshold condition, and as indicated, the second alarm is audible within a range of distance from the first base forming means likewise greater than the distance corresponding to the threshold condition in the first receiver means.

In some embodiments, the first transmitter means are armed or controlled by a transmit switch which is key actuated or otherwise selectively actuatable by external means in the control of the monitoring person. The signal responsive means may be adapted to sound the second alarm only so long as the second transmitter means are transmitting to the first receiver means. Or the signal responsive means may be adapted to sound the second alarm indefintely once they have been actuated, and even after the second transmiter means are no longer transmitting the second signal. In the latter case, there are additional means for resetting the signal responsive means to silence the second alarm and arm the apparatus for a further operation.

In certain embodiments, there are operator-perceptible indicator means connected with the first receiver means to visibly represent the receipt of the first signal and to provide a distinquishable loss of the same when the threshold condition is reached.

The first transmitter and first receiver means may be adjustable to vary the distance at which the threshold condition occurs.

BRIEF DESCRIPTION OF THE DRAWINGS

These features will be better understood by reference to the accompanying drawing which schematically illustrates a presently preferred embodiment of the invention for monitoring a child.

DESCRIPTION OF THE PREFERRED EMBODIMENT

Referring to the drawing, it will be seen that the apparatus comprises a pair of portable radio-operated alarm units 2 and 4. The units are preferably highly reduced in size so that at least one unit, 2, is sufficiently miniaturized and compactly housed that it can be concealed on the child, such as in a barrette worn by a female child. The other unit, 4, may be larger and more openly carried, such as in a clip-on case (not shown) worn by the child's parent in a coat pocket or on a belt. Each unit has a low power, transistorized radio transceiver 6 or 8 therein, which in turn has an antenna 10 or 12 extending therefrom and is supplied by an inboard battery 14 or 16. The child's unit 2 is mounted on a base 18 which is detachably securable to the child's person, for example, to the child's hair as indicated. The transceiver 6 of the unit comprises a radio transmitter 20 for broadcasting a reference signal whose strength diminishes with increasing distance from the transmitter. It also comprises a radio receiver 22 which is tuned to receive a second and different signal—a locator signal—selectively generated by the parent through his or her own transceiver 8, as shall be explained. The child's receiver 22 is accompanied in turn by an audible alarm device 24 which is equipped with a speaker as shown and mounted on the base 18 in circuit with the receiver. It is also accompanied by a signal responsive device 26 which is interposed in the circuit 27 between the receiver and the alarm device to actuate the alarm when the parent's locator signal is received in the receiver. The alarm device in turn produces a loud, piercing raucous noise which is readily perceptible to the parent within the intended range of operation for the apparatus.

The parent's unit 4 is mounted on a base 28 which as indicated, is detachably securable to his or her person, and is preferably storable with the child's unit 2 in a small case (not shown) when out of use. The transceiver 8 of the parent's unit 4 comprises a radio transmitter 30 which is adapted to broadcast a locator signal that is stronger and more far ranging than that emanating from the child's unit, so that it can reach the child's unit well outside of the distance at which the child's signal is lost. The parent's transceiver 8 also comprises a radio receiver 32 which is tuned to receive the child's signal within the area of operation contemplated for the apparatus. The receiver 32 is accompanied by a beeping device 34, and a threshold detection device 36 which monitors the child's signal and detects a threshold condition at which the signal reaches a level that is undesirable. The beeping device 34 is equipped with a speaker as shown and is in circuit with the receiver. The detection device 36 is interposed in the circuit 37 and operable to actuate the beeping device when the threshold condition occurs. A light bulb 38 is also in the circuit with the receiver, to indicate when the child's signal is being received. So long as this light is shining, it indicates that the threshold condition has not been reached. However, when the condition is reached, the light will no longer show, or will show less brightly. There is this additional indicator, therefore, to alert the parent to the fact that the condition has been reached.

The child's unit 2 is equipped with a key-actuated transmit switch 40 by which the parent can activate the unit when it is put to use. Once the unit is activated, it will continue to broadcast the reference signal indefinitely; and so long as the child is in the company of the parent, though they are separated by space 42, the parent's unit 4 will continue to receive the signal, as reflected by the presence of light in the bulb 38. However, should the space 42 exceed the threshold distance, then the device 36 will sound the beeper 34 and alert the parent to this fact. At the same time, the light 38 will no longer shine, or will dim perceptively. The parent can respond to the condition by activating his or her transmitter 30, using a button switch 44 thereon, to broadcast the locator signal which in turn activates the raucous alarm 24 in the child's unit. This in turn notifies the parent of the child's location, and enables the parent to seek out the child, while continuing if he chooses, to activate the alarm with the button 44 on his unit. Alternatively, the device 26 in the child's unit may be adapted to sound the alarm 24 indefinitely once it is actuated. In such a case, once the child is located, or the child's unit is otherwise ready to be deactivated, a key-actuated reset mechanism 46 on the unit can be operated to silence the alarm and reset the device 26 for the next usage.

The parent's unit 4 is turned on and off by a switch 48.

The components of the respective radio alarm units are readily available on the market and in suitable miniaturized form. The parent's unit 4 may comprise a circuit 32, 37, 36 in which the device 36 is responsive to the reference signal to render the alarm 34 inoperative when the signal is above a minimum strength, but permit the alarm to become operative when the signal falls below that strength. Or the unit 4 may comprise a circuit in which the device 36 is inoperative when the signal is above a minimum strength, but responsive to the signal falling below that strength to operate the alarm 34. For example, the child's transmitter 20 may broadcast a pulse coded transmission and the parent's device 36 may demodulate and decode the transmission and compare it with a preset reference, the alarm 34 being given when the transmission falls below that reference.

Both the switch 40 and the reset mechanism 46 may be actuated by a punched in code, rather than key actuated. They should be tamper-proof.

Preferably, the child's transmitter 20 and the parent's receiver 32 are adjustable to vary the distance at which the threshold condition occurs.

What is claimed is:

1. Electronic monitoring apparatus whereby a person can monitor the whereabouts of another person, pet or article, and when desired, locate the monitored person, pet or article if he, she or it becomes separated from the monitoring person, or is shielded from the latter by an obstruction, comprising first and second base forming means which are separate and independent from one another, the first base forming means being portable and securable to the person, pet, or article to be monitored so that they are transportable with him, her or it to points spaced apart from the second base forming means, and being equipped with first antenna means and battery operated first radio transmitter means which are operable through the first antenna means to broadcast a first radio signal into the aforesaid space between the respective base forming means, the second base forming means having first radio receiver means thereon and second antenna means connected therewith through which they receive the first radio signal at least up to the incidence of a predetermined threshold condition therein, there being means for producing a first alarm which is audible or visible to a person in the ambient region surrounding the second base forming means, condition responsive means responsive to the incidence of the threshold condition in the first receiver means to actuate the first alarm producing means, and second radio transmitter means which are operable through the second antenna means to broadcst a second radio signal into the space between the respective base forming means, the second transmitter means having selectively operable control means connected therewith whereby the monitoring person can actuate the second transmitter means to broadcast the second radio signal into the space between the base forming means when desired, and the first base forming means also having means thereon for producing a second audible alarm, battery operated second radio receiver means thereon for receiving the second radio signal through the first antenna means, and signal responsive means thereon which are responsive to receipt of the second radio signal to actuate the second alarm, the second alarm being adapted so that it is audible within a range of distance from the first base forming means commensurate with the threshold condition in the first receiver means, so that the monitoring person, upon hearing or seeing the first alarm, can actuate the second transmitter means to locate the monitored person, pet or article by the sound of the second alarm thereon.

2. The electronic monitoring apparatus according to claim 1 wherein the second base forming means are portable and securable to the monitoring person; the first alarm producing means, the condition responsive means, the second transmitter means, the second antenna means, and the control means are all disposed on the second base forming means; and the first receiver means and the second transmitter means are battery operated through the second antenna means.

3. The electronic monitoring apparatus according to claim 1 wherein the first transmitter means are adapted to broadcast a signal whose strength diminishes in relation to the distance of the same from the first base forming means, and the first receiver means are adapted to receive the signal at least until it falls off to a predetermined low strength condition, the condition responsive means being responsive to that low strength condition to actuate the first alarm producing means, the second transmitter means being adapted to broadcast a signal that is more far reaching than the distance corresponding to this threshold condition, and the second alarm being audible within a range of distance from the first base forming means likewise greater than the distance corrsponding to the threshold condition in the first receiver means.

4. The electronic monitoring apparatus according to claim 1 wherein the first transmitter means are controlled by a transmit switch which is selectively actuatable by external means in the control of the monitoring person.

5. The electronic monitoring apparatus according to claim 1 wherein the signal responsive means are adapted to sound the second alarm only so long as the second transmitter means are transmitting to the first receiver means.

6. The electronic monitoring apparatus according to claim 1 wherein the signal responsive means are adapted to sound the second alarm indefinitely once they have been actuated, and there are means for resetting the signal responsive means to silence the second alarm and arm the apparatus for a further operation.

7. The electronic monitoring apparatus according to claim 1 wherein there are operator perceptible indicator means connected with the first receiver means to visibly represent the receipt of the first signal and to provide a distinguishible loss of the same when the threshold condition is reached.

8. The electronic monitoring apparatus according to claim 1 wherein the first transmitter and first receiver means are adjustable to vary the distance at which the threshold condition occurs.

* * * * *